US006094960A

United States Patent [19]

Kane et al.

[11] Patent Number: 6,094,960

[45] Date of Patent: Aug. 1, 2000

[54] METAL STRIP BENDING DEVICE

[76] Inventors: Kevin Alan Kane, 8763 Pinion Dr., Lake Worth, Fla. 33467; David Peter Kane, 12109 53rd Rd. N., Royal Palm Beach, Fla. 33411

[21] Appl. No.: 09/294,587

[22] Filed: Apr. 20, 1999

[51] Int. Cl.[7] ..... B21D 5/04

[52] U.S. Cl. ..... 72/319

[58] Field of Search ..... 72/319, 320, 307, 72/388, 387

[56] References Cited

U.S. PATENT DOCUMENTS

| | | | |
|---|---|---|---|
| 1,512,002 | 10/1924 | Kardong | 72/288 |
| 4,049,026 | 9/1977 | Del Fabro | 72/307 |
| 4,773,284 | 9/1988 | Archer | 72/307 |
| 4,944,176 | 7/1990 | Glorieux | 72/319 |
| 5,461,893 | 10/1995 | Tyler | 72/307 |
| 5,870,919 | 2/1999 | Song | 72/307 |
| 5,881,591 | 3/1999 | Ondracek | 72/319 |

FOREIGN PATENT DOCUMENTS

| | | | |
|---|---|---|---|
| 858K975 | 8/1981 | U.S.S.R. | 72/307 |

*Primary Examiner*—Daniel C. Crane
*Attorney, Agent, or Firm*—McHale & Slavin

[57] ABSTRACT

A device for bending strips of metal includes a pair of cooperating holding strips adjustably mounted on a support platform. A plate orienting means selectively positions the holding plates with respect to each other, allowing the plates to hold a metal strip during the bending process. An tapered press wedge is rotatably mounted on the support platform and cooperates with the holding plates to allow operator-controlled bending of the strip secured by the holding plates. An articulation handle incorporated into the press wedge allows an operator to produce the leverage sufficient to bend the strip. The device allows an operator to make either a single bend or a series of bends with equal ease.

4 Claims, 3 Drawing Sheets

METAL STRIP BENDING DEVICE

FIELD OF THE INVENTION

This invention is directed to bending devices generally and, in particular, to a bending device for producing spacer strips used to form illuminated letters for signs.

BACKGROUND OF THE INVENTION

Lighted signs are commonly used as a tool for identifying stores or other types of businesses. Often, these signs are formed from a series of discrete, three-dimensional letters. These letters, commonly known as "channel letters," typically include congruent front and/or back panels spaced apart by a rigid spacer band extending perpendicularly between the panel perimeters. The spacer band maintains the panels in a parallel, spaced-apart orientation. With this arrangement, the letters may be fitted with an internal light source and lit from within. Typically, at least the front panel of these letters is transparent or translucent, allowing light from within the letter to pass through the front panel, thereby illuminating the letter to passersby.

Various methods have been developed to efficiently and accurately produce these letters. The front and rear panels may be formed, for example, by cutting around a template or stencil. Letters may also be stamped from large sheets of material. Corresponding spacing strips, however, are harder to produce. Typically, the letter panel spacing strips are formed by cutting a strip of metal sheet stock to a precalculated length that is appropriate for a desired letter. Then, the strip is bent at a series of key locations to produce a bounded region that will follow the contours of the selected letter. The strips also often include edge flanges that increase structural integrity. Collectively, these flanges also form surfaces that allow secure attachment of the panels to the spacing strip. Additionally, the flanges may be used to secure the completed letter to a wall or other mounting surface.

Many devices have been designed to help form the spacing strips used in illuminated, or "channel" letters. For example, U.S. Pat. No. 5,367,902 discloses a metal sheet bending machine that uses a computer and an associated CCD camera to control the motions of a mechanized bending ram. The camera and computer of the '902 device cooperate with included light sources. These components work in concert during the bending of a metal strip to record and process a series of images taken while the metal strip is being bent. Real-time changes between the recorded images act as cues through which the computer guides the motion of the bending ram. The '902 device also displays the recorded images on a display, thereby allowing confirmation of the strip bending progress. Although the '902 device may help in some situations, the large number of components make this device cost-prohibative for many manufacturers. The '902 device also requires careful maintenance to ensure proper calibration of the various components.

Other devices also exist. For example, U.S. Pat. No. 5,377,516 discloses a method and apparatus for bending metal sheet stock. The '516 patent discloses a computerized system that produces a set of instructions for bending a suitable strip of metal into a letter-bounding shape. The included computer calculates the bends required to produce the desired shape and determines an appropriate sequence of bending that will produce the chosen shape without interference between the bending mechanism, the strip to be bent, and the already-bent portion of the strip. Once the bending sequence is identified, the device produces instructions and visual guides that may be printed directly onto the selected strip of material or that may be printed onto an adhesive label for subsequent application. Although the '516 device may provide some guidance to help direct bending, the '516 device does not ease the actual bending process itself.

Although the known methods may ultimately result in bent strips, they are very costly, both in terms of space required and in terms of purchase and maintenance costs. Thus, what is needed is a metal bending device that includes advantages of the known devices, while addressing the shortcomings they exhibit. The device should be inexpensive to obtain, simple to operate, and easy to maintain. The device should also be useable with strips having a variety of widths and thicknesses. The device should allow an operator to produce individual bends or a series of bends with equal ease. The device should also allow an operator to produce customized spacer strips for illuminated letters, with each strip having customized bends and a variety of angles.

SUMMARY OF THE INVENTION

The instant invention is a metal strip bending device used during the formation of spacer panel spacing strips found in illuminated signs. The bender device employs a pair of holding plates that cooperatively secure a strip of metal stock to be bent. The holding plates are mounted on a support platform and are selectively positionable with respect to each other. The holding plates secure the metal strip during the bending process.

An arc-shaped press wedge is rotatably mounted on the support surface. The press wedge is rotatable from one of two loading positions into a corresponding strip-bending positions. An articulation handle mounted on the wedge allows an operator to rotate the press wedge with large amounts of leverage. The leverage allows the operator to produce torque sufficient to bend a metal strip secured by the holding plates.

Thus, an objective of the instant invention is to provide a metal strip bending device that is inexpensive to obtain, simple to operate, and easy to maintain.

An additional objective of the present invention is to provide a metal strip bending device that is useable with strips of various widths and thicknesses.

Still another objective of the present invention is to provide a metal strip bending device that allows an operator to produce individual bends or a series of bends with equal ease.

Yet another objective of the present invention is to provide a metal strip bending device that allows an operator to produce customized spacer strips for illuminated letters, with each strip having customized bends and a variety of angles.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENT

Figure 1:
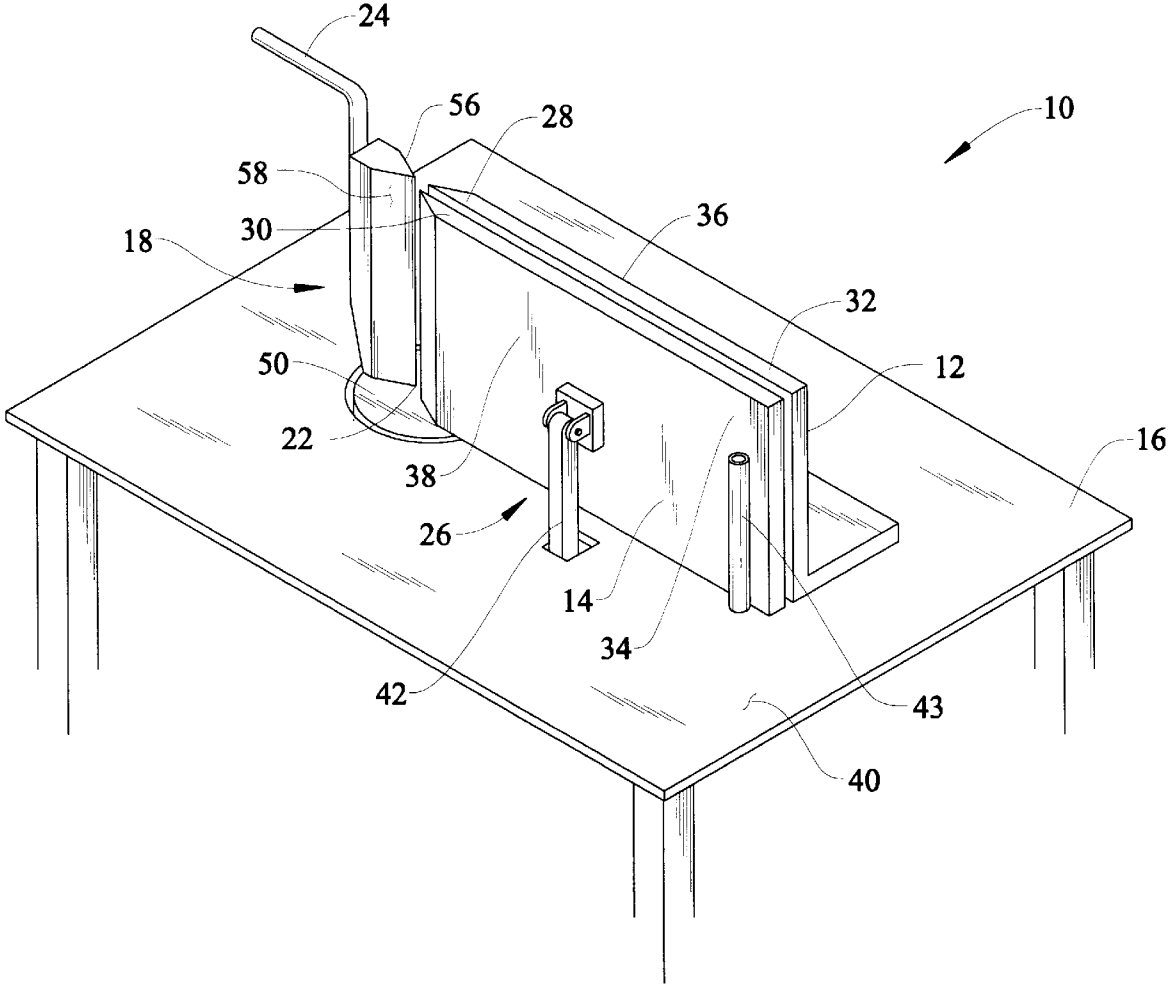
FIG. 1 is a pictorial view of the metal bending device of the present invention.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown in the drawings and described in the specification.

Now with reference to FIGS. 1 and 2, the bending device 10 of the present invention will be described. By way of overview, the bending device 10 includes a pair of holding plates 12,14 that are oriented perpendicular to a support platform 16. A press wedge 18 is rotatably associated with the support platform 16 and cooperates with the holding plates 12,14 to bend a selected strip of metal 20. The press wedge 18 rotates about a pivot axis 22 and includes an articulation handle 24 that allows operator-controlled rotation of the press wedge. The spacing between the holding plates 12,14 is adjusted by a plate orienting means 26. The bending device 10 will now be discussed in detail.

Figure 2:
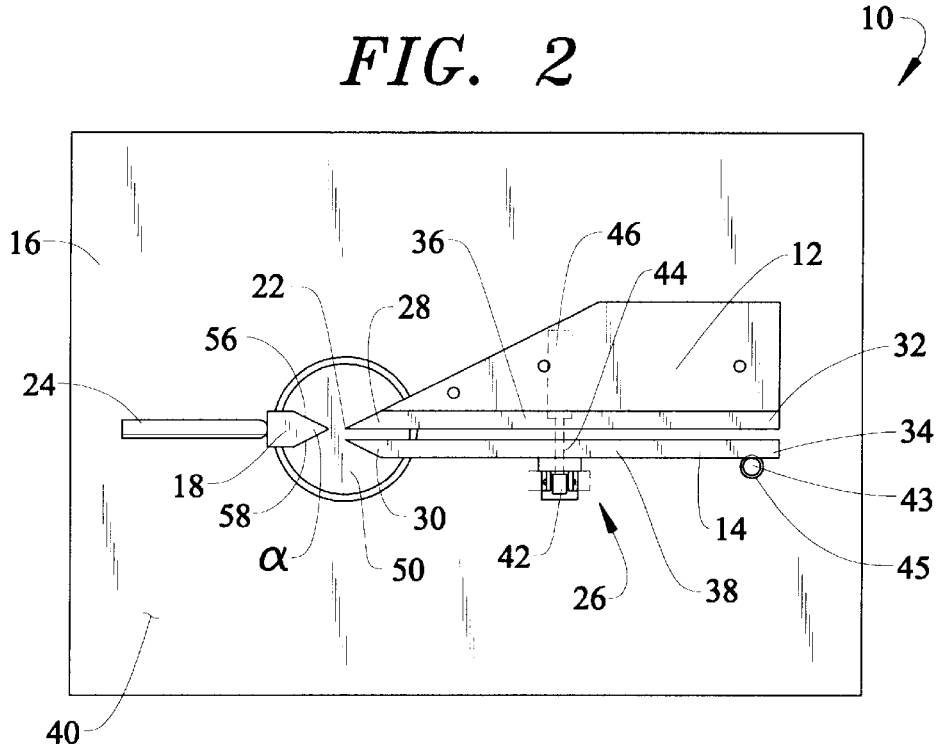
FIG. 2 is a top plan view of the metal bending device shown in FIG. 1.

With continued reference to FIG. 1, the metal bending device 10 includes a first holding plate 12 that cooperates with a second holding plate 14 to selectively secure a chosen strip of metal 20 in preparation for bending. Each of the holding plates includes a first end 28,30 that is spaced apart from a second end 32,34 by a middle portion 36,38. Each of the holding plate first ends 28,30 is tapered, with each plate 12,14 being most narrow closest to the press wedge 18. In a preferred embodiment, the plate middle portions 36,38 are flat.

As seen with continued reference to FIG. 1, a plate orienting means 26 allows selective positioning of the holding plates 12,14. In one embodiment, the first holding plate 12 extends orthogonally from the top surface 40 of the support platform 16 and has an L-shaped cross-section. The first holding plate 12 is fixed in place. The second holding plate 14 is also orthogonally aligned with the surface 40 of the support platform 16, but the second holding plate is affixed to a movable linkage arm 42. The linkage arm 42 attaches the second holding plate 14 to a positioning piston 44, thereby allowing the second holding plate to move with respect to the first holding plate 12.

Figure 3:
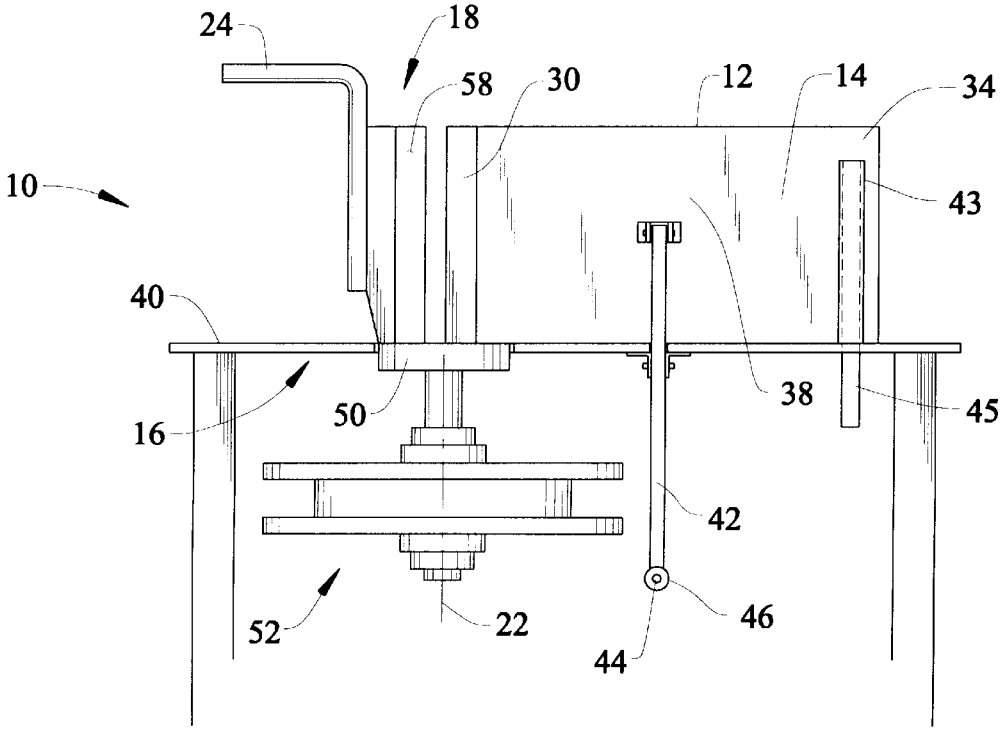
FIG. 3 is a side elevation view of the metal bending device shown in FIG. 1.

With additional reference to FIG. 3, the second holding plate 14 includes a mounting sleeve 43 that cooperates with a mounting post 45 to allow pivotal motion of the second holding plate 14. More particularly, the mounting sleeve 43 allows the second holding plate 14 to pivot about the mounting post 45 in response to motion of the linkage arm 42 and positioning piston 44.

In a preferred embodiment, the mounting post 45 extends upward from the support platform 16. Motion of the linkage arm 42 is controlled by a hydraulic pump 46; the pump may be controlled by a foot-operated actuation lever, not shown. Although the position of the second holding plate 14 is controlled via a hydraulic pump 46, other movement arrangements, such as a threaded worm gear, not shown, or an expandable lattice-type assembly, not shown, may also be used. Additionally, the first holding plate 12 may also be movable, either alone or in cooperation with the second holding plate 14.

Figure 4:
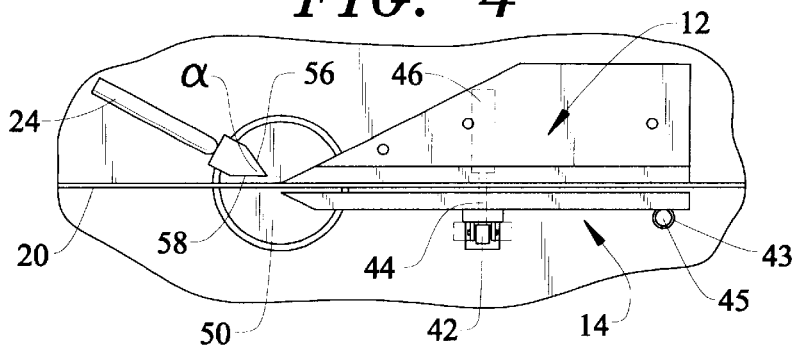
FIG. 4 is a partial top plan view of the metal bending device of the present invention, with the holding plates spaced apart and a strip of metal positioned for bending.

Now with additional reference to FIGS. 4,5, and 6, the press wedge 18 will be described. The press wedge 18 is a cylinder having a region with a triangular-shaped cross section. The triangular region is bounded by a first contact surface 56 and a second contact surface 58. More particularly, as shown in FIG. 4, the press wedge 18 is shaped so that the first contact surface 56 will come to rest against the first holding plate first end 28, allowing the second contact surface 58 to rotate clear of the holding plate first ends 28,30. In a preferred embodiment, the press wedge first and second contact surfaces 56,58 form an acute angle $\alpha$.

The shape of the press wedge 18 alternately allows the second contact surface 58 to rest against the second holding plate first end 30 while the first contact surface 56 has rotated clear of the holding plate first ends 28,30. As a result, a strip of metal 20 may be placed lengthwise between the holding plates 12,14, with the strip 20 extending past the holding plate first ends 28,30, in preparation for bending by the press wedge 18. Although the angle between the press wedge contact surfaces $\alpha$ is preferably acute, other geometries may be used to accommodate different types of metal strips 20, or to allow different types of bends.

With additional reference to FIGS. 1 and 3, the press wedge 18 is oriented orthogonally with respect to the support platform top surface 40 and rotates with respect thereto. More particularly, the press wedge 18 is mounted on a press wedge support plate 50 that is rotatably disposed within the support platform 16. The support plate 50 is, in turn, disposed on a low-friction support plate mounting assembly 52 located below the support platform 16.

A rigid articulatio n handle 24 extends from the press wedge 18, thereby allowing operator-driven rotation of the press wedge with respect to the support platform 16 and the holding plates 12,14. The inclusion of the articulation handle 24 also advantageously increases the amount of leverage available to an operator, the re by allowing the operator to produce torque sufficient to bend the metal strip 20 secured between the holding plate fir st ends 28,30.

Because of the novel shape of the press wedge 18, the device 10 may be used to form both "right facing" and "left facing" bends. With reference to FIGS. 4,5, and 6, formation of a "left facing" bend will now be described. In preparation for bending, the plate orienting means 26 is operated to place the holding plates 12,14 in a spaced-apart relationship, as shown in FIG. 4. Then, the press wedge 18 is rotated so that the first contact surface 56 approaches the first holding plate first end 28; this allows the press wedge second contact surface 58 to occupy a coplanar relationship with the first holding plate middle portion 36. A selected strip of metal stock 20 is placed between the spaced-apart holding plates 12,14, with a portion of the strip lying against the second contact surface 58.

Figure 5:
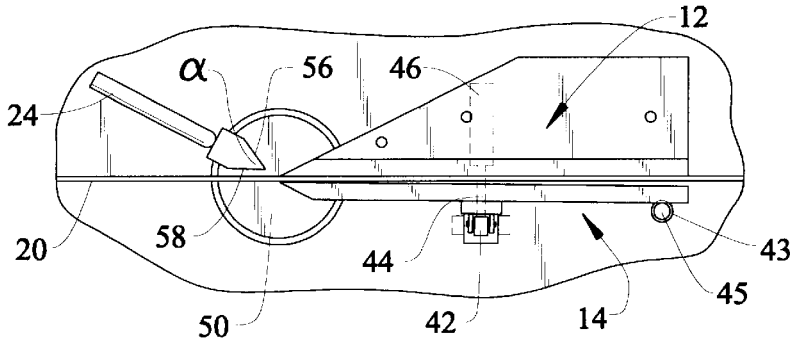
FIG. 5 is a partial top plan view of the metal bending device of the present invention, with the holding plates closed, holding a strip of metal in place for bending.
Figure 6:
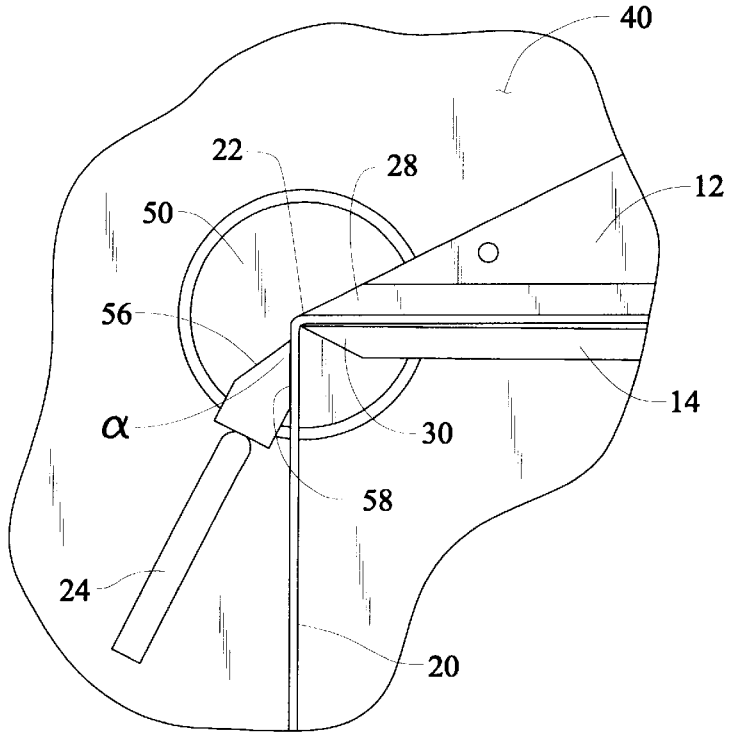
FIG. 6 is a close up plan view of the metal bending device of the present invention forming a "left facing" bend in a strip of metal.

Once the metal strip 20 is in place, the plate orienting means 26 is operated to bring the holding plates 12,14 together, into a strip-securing relationship, as shown in FIG. 5. Now with reference to FIG. 6, to bend the metal strip 20, the press wedge 18 is turned counterclockwise, via the articulation handle 24, so that first contact surface rotates away from the first holding plate first end 28 and the second contact surface 58 rotates toward the second holding plate first end 30, thereby bending the strip of metal 20 positioned between the holding plates 12,14.

The press wedge 18 height preferably corresponds with the height of the holding plates first ends 28,30. However, the press wedge may be made taller or shorter to accommodate strips 20 of various heights. Additionally, the press wedge 18 cross section may be modified, if needed, to accommodate metal strips 20 of different thicknesses. A spacing shim, not shown, may also be placed below between the holding plates 12,14 and the support platform to maintain the inserted metal strip 20 in an elevated position with respect to the top surface 40 of the support platform 16, thereby ensuring that the metal strip 20 will slide smoothly, even if the top surface 40 of the support platform 16 has developed imperfections or is otherwise not planar. It is also noted that although the bending device 10 of the present invention has been described as suitable for bending strips of metal 20, the device may also be used to bend other similarly-flexible materials as well.

Although the invention has been described in terms of a specific embodiment, it will be readily apparent to those skilled in this art that various modifications, rearrangements and substitutions can be made without departing from the spirit of the invention. The scope of the invention is defined by the claims appended hereto.

What is claimed is:

1. A metal bending device for bending sheet stock, said device consisting of:

a support member;

a first holding plate mounted on said support member, said first holding plate being characterized by a first end spaced apart from a second end by an elongated middle portion;

a second holding plate adjustably spaced apart from said first holding plate, said second holding plate being characterized by a first end spaced apart from a second end by an elongated middle portion, plate orienting means for selectively adjusting the relative distance between said first holding plate and said second holding plate, said plate orienting means including a positioning piston operatively associated with said second holding plate;

a press wedge rotatably disposed adjacent to said holding plate first ends, said press wedge being aligned substantially parallel to said holding plate first ends;

press wedge orienting means for selectively positioning a press wedge first contact surface and a press wedge second contact surface with respect to said holding plate first ends;

said press wedge orienting means including a support plate rotatable disposed with said support member, said support plate being constructed and arranged to position said press wedge with respect to said support member and said holding plate first ends; and an extended articulation handle constructed and arranged to rotate said press wedge and said support plate about a pivot axis; and wherein said articulation handle allows an operator to apply a strip-bending-sufficient amount of torque to said press wedge;

whereby said first and second holding plates are adapted to cooperatively hold a strip of metal between said plate first ends, and whereby rotation of said press wedge will bend said strip of metal.

2. The metal bending device of claim 1, wherein said press wedge first contact surface and said press wedge second contact surface form an acute angle.

3. The metal bending device of claim 1, wherein each of said holding plate first ends is tapered.

4. The metal bending device of claim 1, wherein said positioning piston is actuated by a hydraulic pump.

* * * * *